United States Patent [19]

MacIntyre

[11] 4,361,347

[45] Nov. 30, 1982

[54] SKI POLE BASKET CARRIER SYSTEM

[76] Inventor: Robert W. MacIntyre, 103 Grove St., Concord, Mass. 01742

[21] Appl. No.: 170,765

[22] Filed: Jul. 21, 1980

[51] Int. Cl.[3] ..... A63C 11/02

[52] U.S. Cl. ..... 280/814; 224/917; 280/820

[58] Field of Search ..... 280/820, 824, 814, 815, 280/821, 822; 224/917; 294/147

[56] References Cited

U.S. PATENT DOCUMENTS

| | | | |
|---|---|---|---|
| 3,354,675 | 11/1967 | Quigg | 280/814 |
| 4,002,349 | 1/1977 | Dopp | 280/814 |
| 4,175,683 | 11/1979 | Shields | 280/814 |
| 4,247,132 | 1/1981 | Shields | 280/820 |

FOREIGN PATENT DOCUMENTS

| | | | |
|---|---|---|---|
| 2101611 | 7/1971 | Fed. Rep. of Germany | 280/820 |
| 1522547 | 4/1968 | France | 280/814 |

*Primary Examiner*—David M. Mitchell
*Attorney, Agent, or Firm*—Joseph S. Iandiorio

[57] ABSTRACT

A ski pole basket carrier system for carrying a pair of skis and poles as a unit including first and second pairs of interconnection means, one pair at the forward end and one pair at the rearward end of the skis; first and second ski pole baskets, each basket including a center hole for engaging the lower end of one ski pole and at least one recess disposed for releasably receiving the other ski pole; means for securing the other ski pole in the recess; and means for releasably engaging a pair of the interconnection means on the skis.

10 Claims, 4 Drawing Figures

SKI POLE BASKET CARRIER SYSTEM

FIELD OF INVENTION

This invention relates to a ski pole basket carrier system which uses the ski pole baskets to join the ski poles and skis as a unit for handling and carrying.

BACKGROUND OF INVENTION

Presently available devices for holding together skis and ski poles in a unit for ease of carrying and storing suffer from a number of shortcomings. Generally there is provided a separate device which represents a significant extra expense and an additional piece of equipment to look after. These devices tend also to be complex and require separate care and maintenance. They must be stored somewhere at the ski area when the skis are in use. This may require the skier to undertake the added expense of locker rental or the added nuisance of carrying the device around with him, and these devices are often quite heavy and/or bulky. Often there is required major modification or addition to the skis and/or poles to accommodate the device. In addition to the added cost and effort, such modifications and additions may be annoying or interfere with the skier's use and enjoyment of the skis.

SUMMARY OF INVENTION

It is therefore an object of this invention to provide an improved, simple and inexpensive device for joining a pair of ski poles and skis into a single, easily transportable unit.

It is a further object of this invention to provide such a device which is integral with the skis and poles and requires no, or at worst only a few, extra parts.

It is a further object of this invention to provide such a device in which the modification and/or addition to the equipment is minimal and does not burden the skier.

It is a further object of this invention to provide such a device in which the ski pole basket functions as the means to join the skis and poles.

It is a further object of this invention to provide such a device having means for receiving theft-preventing locking means.

This invention features a ski pole basket carrier system for carrying a pair of skis and poles as a unit. There are first and second pairs of interconnection means located one pair at the forward end and one pair at the rearward end of the skis. There are also first and second ski pole baskets, each basket including a center hole for engaging the lower end of a ski pole in the usual fashion and at least one recess disposed on the basket for releasably receiving the other ski pole. There are means for securing the other ski pole in the recess. Means are also provided on the basket for releasably engaging with a pair of the interconnection means on the skis.

In a preferred embodiment the means for releasably securing includes, at the mouth of the recess, restriction means smaller than the diameter of the ski pole received therein. The restriction means may include at least one flexible portion for allowing a ski pole to be snap fit through the restriction means into the recess. The means for releasably engaging the interconnection means may include a pair of detents, and the interconnection means may include holes in the skis for receiving the detents. The detents may be flexible to allow them to snapfit in engagement with the holes. The interconnection means may also include a member for attachment to the ski in which the member provides a hole to receive the detent. The baskets may include one or more, and preferably three, pole-receiving recesses and one or more, preferably three, means for releasably engaging with the interconnection means on the skis. In addition the baskets may include one or more holes for receiving theft-prevention locking means.

DISCLOSURE OF PREFERRED EMBODIMENT

Other objects, features and advantages will occur from the following description of a preferred embodiment and the accompanying drawings, in which.

The invention may be accomplished with a ski pole basket carrier system that joins a pair of skis and poles to form a unit for easy carrying and handling. There are first and second pairs of interconnection means, one pair at the forward end and one pair at the rearward end of the skis. The interconnection means may be simply holes formed in the skis, or they may be a member with a hole formed in it, which member is attached to the skis. Alternatively, the basket may carry the holes and the skis the detents.

There are first and second ski pole baskets. Each basket includes a center hole for engaging the end of a ski pole in the usual fashion. In addition, each basket includes at least one recess disposed for releasably receiving the other pole, typically at a position along the pole near its upper or handle end. There are means for securing that other ski pole in the recess. This means may be any sort of conventional latch or strap means or may be merely a restrictive structure at the mouth of the recess; the opening of the recess may be made slightly smaller than the pole so that the pole can be snap fitted through the mouth into the recess. In addition the basket carries means for releasably engaging the interconnection means; that is, the holes on the skis. The means for releasably engaging may be simply a pair of detents that are flexible so that they can snap fit into the holes on the skis. Conversely, the holes may be carried by the basket and the detents may be carried by the skis. For ease of manufacture and for aesthetic appeal, each basket typically has three recesses and three means for releasably engaging a pair of interconnection means; each recess is associated with a means for releasably engaging and is spaced uniformly about the basket. If only one recess is used on each basket they must be disposed relative to each other so that the poles do not physically interfere with each other in engaging the recesses. One or more holes are provided in each basket to receive a lock hasp or cable for locking against theft.

Figures 1, 2:
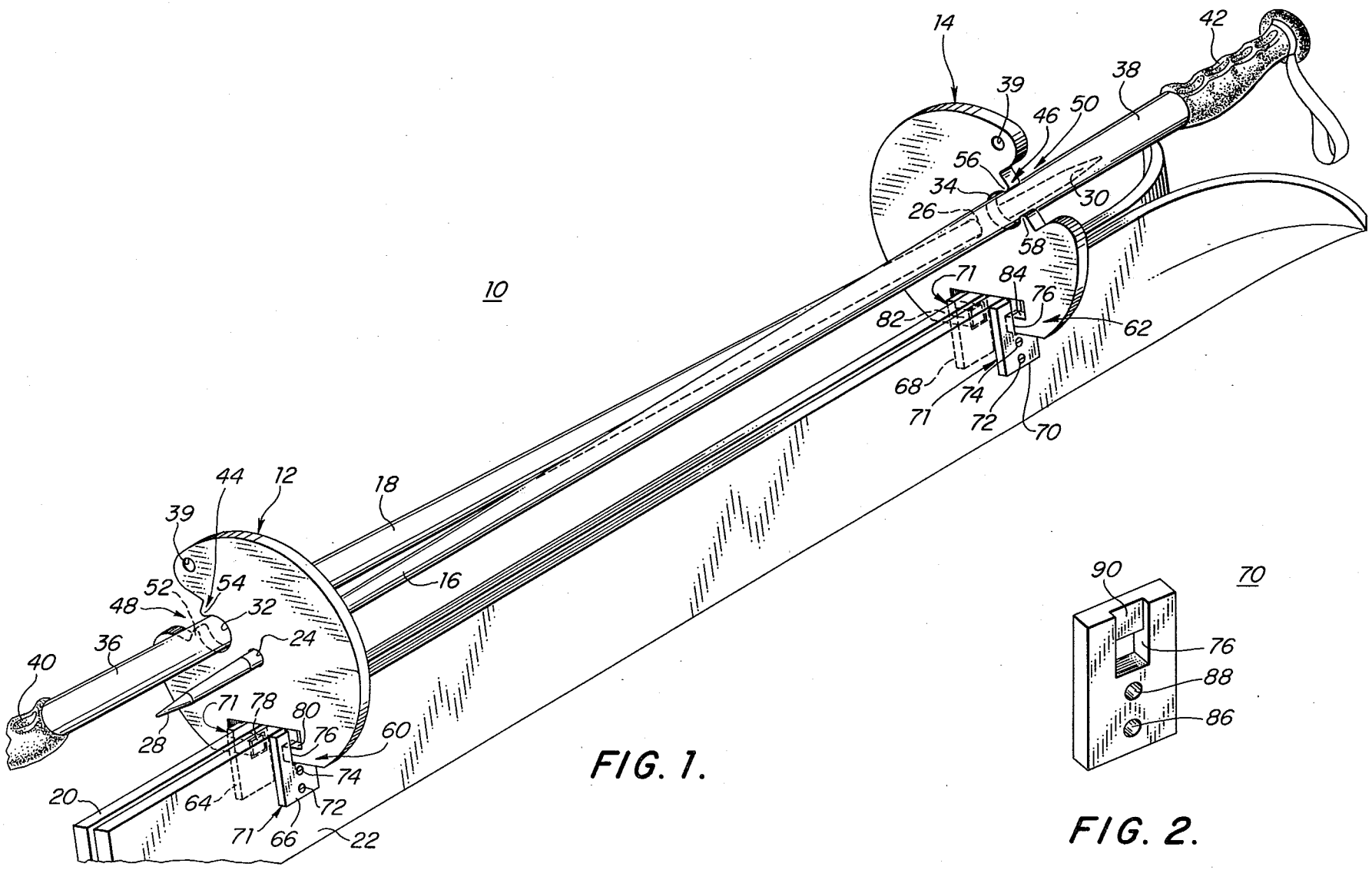
FIG. 1 is an axonometric view of a pair of skis and poles joined together using a ski pole basket carrier system according to this invention.
FIG. 2 is an enlarged axonometric view of the interconnection members that may be mounted on the skis.

There is shown in FIG. 1 a ski pole basket carrier system 10 according to this invention which includes baskets 12 and 14 interconnected with poles 16 and 18, respectively, and a pair of skis 20, 22. Each basket includes a center hole 24, 26 for receiving the lower pointed end 38, 30, of a ski pole in the usual manner. In addition each basket includes a recess 32, 34 for releasably receiving the other pole at its upper portion 36, 38 near handles 40, 42. Some means is provided for securing the upper portions 36, 38 of ski poles 16, 18 in recesses 32, 34, respectively, FIG. 1. One technique uses restriction means 44, 46, at the mouth 48, 50 of recesses 32, 34.

The restriction means 44, 46 may include simply a pair of salient portions 52, 54 and 56, 58, which are spaced apart a distance somewhat less than the width of the poles 16, 18 so that the poles must be snap fitted through them into recesses 32, 34. At least one of the portions 52, 54 and 56, 58 is made somewhat flexible to facilitate the snap-fit function. Recesses 32, 34 must be disposed so that poles 16, 18 when installed as shown in FIG. 1 do not physically block each other. For example, if recess 32 were on the opposite side of basket 12 in the same relative position to the skis as is recess 34 in basket 14, then pole 18 would block pole 16 and prevent it from being received in recess 32 disposed in that alternate position. One or more holes 39 may be provided to receive a lock or cable to secure against theft.

Each basket 12, 14 also includes some means 60, 62 for engaging a pair of interconnection means 64, 66, at the rearward end and 68, 70 at the forward end of skis 20, 22. The interconnection means simply include a member 71 mounted to the skis by means of screws 72, 74 and having a hole 76 which receives detents 78, 80, with respect to basket 12. Interconnection means 68, 70 contain similar holes 76 which engage with detents 82, 84. Members 71 may also be mounted by adhesive or in any other suitable manner or may be integral with the skis.

The structure of members 64, 66, 68 and 70 is shown in more detail in FIG. 2 with respect to member 70, which includes two holes 86, 88 for receiving screws 72, 74 and a generally square hole 76 with the upper end 90 somewhat thinner to facilitate reception of detent 84.

Figure 3:
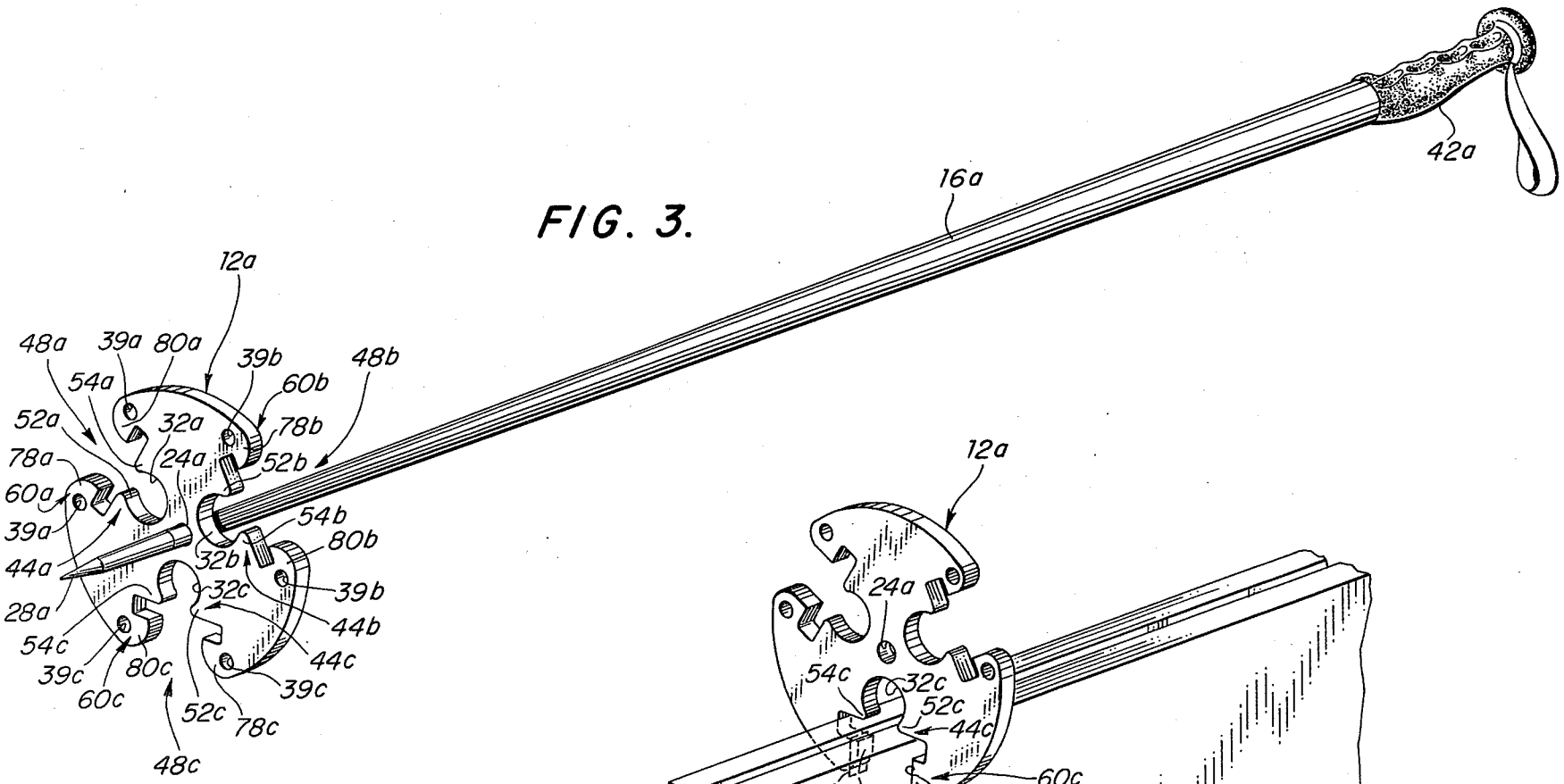
FIG. 3 is an axonometric view of a ski pole with a basket according to this invention.

In one construction in FIG. 3, where like parts have been given like numbers accompanied by a lower case letter, basket 12*a* includes three recesses 32*a*, 32*b*, and 32*c*, each of which includes a pair of salient releasable securing means 44*a*, *b*, and *c* at the mouths 48*a*, *b*, and *c* of recesses 32*a*, *b*, and *c*. The securing means include salient portions 52*a*, *b*, and *c* and 54*a*, *b*, and *c*. Recesses 32*a*, *b*, and *c* are spaced uniformly about basket 12*a* and each has associated with it some means for releasably engaging the interconnection means 60*a*, *b* and *c*, which include detents 78*a* and 80*a*; 78*b* and 80*b*; and 78*c* and 80*c*. The flexibility of the skis is sufficient to allow detents 78, 80 to engage with holes 76, but one or both of detents 78, 80 may be made flexible. Locking holes 39*a*, 39*b* and 39*c* are provided in pairs associated with each recess.

Figure 4:
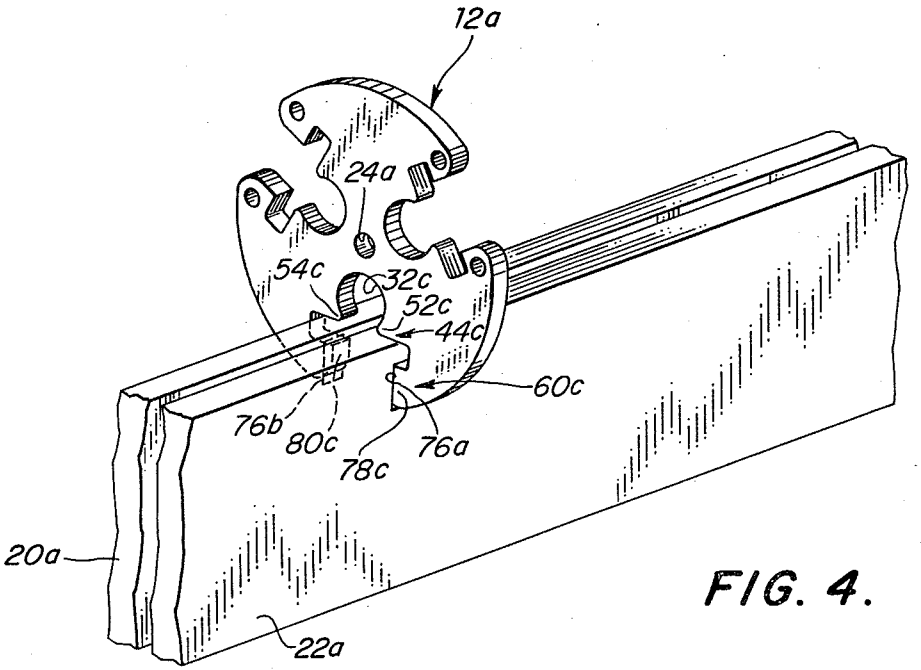
FIG. 4 is an enlarged view of a portion of a pair of skis and a ski pole basket showing the interconnection means formed as an integral part of the skis.

Although the pairs of interconnection means have been shown as discrete members 64, 66, 68 and 70 fastened to the skis and having holes 76 in them for receiving detents 78 and 80, this is not a necessary limitation of the invention. For example, as shown in FIG. 4, skis 20*a* and 22*a* may include simply holes 76*a* and 76*b*. In this construction no extra parts are needed. The basket effects the interlocking function in cooperation with the holes in the skis and the ski poles. For improved versatility each recess may be of a different size to accommodate different size ski poles, and each pair of detents for gripping holes on the skis may be sized and spaced differently to accommodate variations in width of, and size of holes on, different pairs of skis.

Other embodiments will occur to those skilled in the art and are within the following claims:

What is claimed is:

1. A ski pole basket carrier system for carrying a pair of skis and poles as a unit comprising:

first and second pairs of interconnection means, one pair at the forward end and one pair at the rearward end of the skis, said pairs of interconnection means including members having means for attachment to a ski and a hole; and first and second ski pole baskets, each basket including a mounting hole for engaging the lower end of one ski pole, and at least one recess disposed for releasably receiving the other ski pole; means for securing the other ski pole in said recess; and detent means for releasably engaging a pair of said holes in said interconnection means.

2. The system of claim 1 in which said means for releasably securing includes, at the mouth of said recess, restriction means smaller than the diameter of the ski pole received therein.

3. The system of claim 2 in which said restriction means includes at least one flexible portion facilitating snap-fit engagement of a ski pole through the restriction means into said recess.

4. The system of claim 1 in which said first and second baskets each includes three of said pole receiving recesses.

5. The system of claim 1 in which said first and second baskets each includes three of said means for releasably securing.

6. The system of claim 1 in which said first and second baskets each includes three of said means for releasably engaging.

7. The system of claim 1 in which said first and second baskets each includes at least one hole adapted for receiving locking means.

8. A ski pole basket carrier system for carrying a pair of skis and poles as a unit comprising:

a pair of skis having first and second pairs of interconnection means, one pair at the forward end and one pair at the rearward end of the skis, said interconnection means including holes in said skis; and first and second ski pole baskets, each basket including a mounting hole for engaging the lower end of one ski pole, and at least one recess disposed for releasably receiving the other ski pole; means for releasably securing the other ski pole in said recess; and detent means for releasably engaging a pair of said holes in said interconnection means.

9. The system of claim 8 in which at least one of each pair of said detents is flexible for facilitating snap-fit engagement of a said pair of detents with a said pair of holes.

10. A ski pole basket carrier system for carrying a pair of skis and poles as a unit comprising:

first and second pairs of holes, one pair at the forward end and one pair at the rearward end of the skis;

first and second ski pole baskets, each basket including a mounting hole for engaging the lower end of one ski pole, and at least one recess disposed for releasably receiving the other ski pole; means for securing the other ski pole in said recess; and a pair of detents for engaging said holes; at least one of each pair of detents being flexible for facilitating snap-fit engagement of a said pair of detents with a said pair of holes.

* * * * *